US005337529A

United States Patent [19]

Lutin et al.

[11] Patent Number: 5,337,529

[45] Date of Patent: Aug. 16, 1994

[54] ROOF TILE MOUNTING SYSTEM

[76] Inventors: Gregory D. Lutin, 9270 Vedra Pointe La., Boca Raton, Fla. 33496; Peter R. Hill, 730 NW. 91st Terr., Plantation, Fla. 33324

[21] Appl. No.: 96,668

[22] Filed: Jul. 23, 1993

[51] Int. Cl.[5] ..... E04D 1/34

[52] U.S. Cl. ..... 52/389; 52/386; 52/391; 52/384

[58] Field of Search ..... 52/384, 386, 389, 391, 52/422, 390

[56] References Cited

U.S. PATENT DOCUMENTS

| | | | |
|---|---|---|---|
| 950,060 | 2/1910 | Smith et al. | 52/602 |
| 1,183,593 | 5/1916 | Robinson | 52/426 |
| 1,396,764 | 11/1921 | Lancaster | 52/511 |
| 1,871,318 | 8/1932 | Greenwood | 52/602 |
| 2,175,070 | 10/1939 | Turco | 52/391 |
| 4,044,522 | 8/1977 | Sturmer et al. | 52/600 |

FOREIGN PATENT DOCUMENTS

| | | | |
|---|---|---|---|
| 506285 | 10/1951 | Belgium | 52/391 |
| 662944 | 8/1929 | France | 52/391 |
| 767291 | 7/1934 | France | 52/391 |
| 983747 | 6/1951 | France | 52/391 |
| 639825 | 3/1962 | Italy | 52/389 |
| 3-110252 | 5/1991 | Japan | 52/384 |
| 925236 | 5/1963 | United Kingdom . | |

*Primary Examiner*—Carl D. Friedman
*Assistant Examiner*—Kevin D. Wilkens
*Attorney, Agent, or Firm*—Albert W. Hilburger

[57] ABSTRACT

A system is provided for firmly attaching roof tiles to a building. The system includes an underlayment, a layer of adhesive overlying the underlayment and a plurality of ceramic slabs for mounting on the adhesive layer. Anchors are employed for securing the ceramic slabs in a contiguous manner to the adhesive layer. These anchors include a substantially planar first flange which is embedded within the ceramic slab. A web is fixed to the first flange and extends transversely away from the first flange and beyond the ceramic slab. A substantially planar second flange is fixed to the web at a location distant from the first flange and is embedded within the adhesive layer. The first and second flanges are generally parallel and are generally symmetrical relative to the web and are substantially coextensive. In another construction, the first and second flanges define first and second perimeters and the web is attached to both of the flanges at locations substantially central of the perimeters. In still another construction, the web is rectangular and is perpendicular to the first and second flanges. In yet another construction, the web may include at least a single stem member substantially perpendicular to the first and second flanges and the first and second flanges may be disk-shaped.

20 Claims, 2 Drawing Sheets

ROOF TILE MOUNTING SYSTEM

BACKGROUND OF THE INVENTION

1. Field of the Invention

The present invention relates generally to building construction and, more particularly, to a system for securely anchoring roof tiles to an underlayment. Although the system of the invention is primarily directed toward roof construction, the concept of the invention can also be applied to slabs and tiles employed for facing for the interior or exterior of buildings, including dwellings and the like. Such slabs and tiles may be adapted to be secured to wooden, plastered, or other surfaces. Broadly considered, the focus of the invention is, while retaining the bonding material surface of the tile, to increase its fastening efficiency by providing it with a special type of anchoring mechanism, permanently secured or embedded within its own rear surface, and adapted to be secured within the surface to which the tile is to be applied. This is performed in such a manner that, after its application, the tile may be more permanently affixed than by any other devices presently known.

Throughout the instant disclosure, the word "ceramic" is intended to be an all-encompassing term referring to cementitious materials including concrete, clay, and ceramic materials which at one stage of their existence are liquid in form and which in time or upon the application of heat become solidified to a hardened mass.

2. Description of the Prior Art

A number of patents known to the inventors are broadly representative of the general field of devices to which the present invention pertains. For example, U.S. Pat. No. 1,396,764 issued Nov. 15, 1921 to Lancaster discloses tile having integral retention devices adapted to anchor the tile to the surface of plaster, mortar or cement to which the tile is applied.

U.S. Pat. No. 1,871,318 issued Aug. 9, 1932 to Greenwood discloses the use of perforated sheet metal reinforcement plate which is embedded in concrete to form a relatively light precast structural unit.

U.S. Pat. No. 4,044,522 issued Aug. 30, 1977 to Sturmer et al. and U.S. Pat. No. 950,060 issued Feb. 22, 1910 to Smith et al. both generally disclose reinforced structures with associated anchoring devices.

U.S. Pat. No. 1,183,593 issued May 16, 1916 to Robinson and British Specification to Roney et al. published May 1, 1963 both disclose structural building units in which structural components are embedded in concrete.

It was with knowledge of the state of the art as represented by the foregoing patented devices that the present invention has been conceived and is now reduced to practice.

SUMMARY OF THE INVENTION

According to the invention, a system is provided for firmly attaching roof tiles to a building. The system includes an underlayment, a layer of bonding material overlying the underlayment and a plurality of ceramic slabs for mounting on the bonding material layer. Anchors are employed for securing the ceramic slabs in a contiguous manner to the bonding material layer. These anchors include a substantially planar first flange which is embedded within the ceramic slab. A web is fixed to the first flange and extends transversely away from the first flange and beyond the ceramic slab. A substantially planar second flange is fixed to the web at a location distant from the first flange and is embedded within the layer of the bonding material. The first and second flanges are generally parallel, are generally symmetrical relative to the web, and are generally coextensive. In another construction, the first and second flanges define first and second perimeters and the web is attached to both of the flanges at locations substantially central of the perimeters. In still another construction, the web is rectangular and is perpendicular to the first and second flanges. In yet another construction, the web may include at least a single stem member substantially perpendicular to the first and second flanges and the first and second flanges may be disk-shaped.

A primary object of the invention is to provide a tile roof construction which is capable of remaining intact even when subjected to hurricane force winds.

Another object of the invention is to provide a system for mounting ceramic roof tiles to a building such that they remain intact even when subjected to substantial external forces.

Still another object of the invention is to provide a novel anchor construction which is capable of securing ceramic roof tiles in place such that the tiles can withstand excessive external forces without loosening or dislodging.

A further object of the invention is to provide such a novel anchor construction which utilizes a first substantially planar flange embedded within the roof tile itself, an integral, transversely extending web, and a second substantially planar flange also integral with the web and spaced from the first flange. According to this construction, the flanges are generally parallel, generally symmetrical relative to the web, and are substantially coextensive.

Still a further object of the invention is to provide such a novel anchor construction in which the flanges have roughened surfaces, and/or in which at least one of the flanges and the web is perforated, and/or in which the web is a single stem member substantially perpendicular to the flanges, and/or in which the flanges are disk-shaped.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate several embodiments of the invention and, together with the description, serve to explain the principles of the invention in general terms. Like numerals refer to like parts throughout the disclosure.

DETAILED DESCRIPTION OF THE PREFERRED EMBODIMENTS

Figure 1:
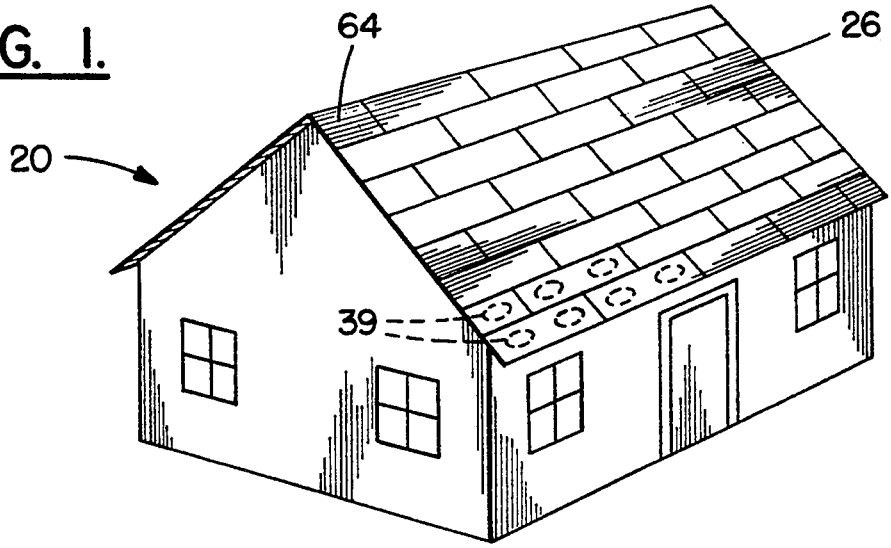
FIG. 1 is a perspective view illustrating a building structure provided with a roof constructed according to the present invention.

Turn now to the drawings and, initially, to FIG. 1 which illustrates a structure 20 such as a building which utilizes a roof tile mounting system embodying the present invention. The roof construction of the building 20 includes a suitable underlayment 22 which supports a layer of bonding material 24, sometimes referred to as "mud" composed of concrete or other suitable substance. In any event, regardless of its composition, the bonding material 24 is applied to the underlayment 22 in a liquid or slurry form. It subsequently solidifies to a hardened mass either with the passage of time or with the application of heat. In turn, a plurality of roof tiles 26, in the form of ceramic slabs, are positioned in side by side relationship contiguous to the bonding material 24 and are secured to the bonding material in a manner to be described.

Figure 2:
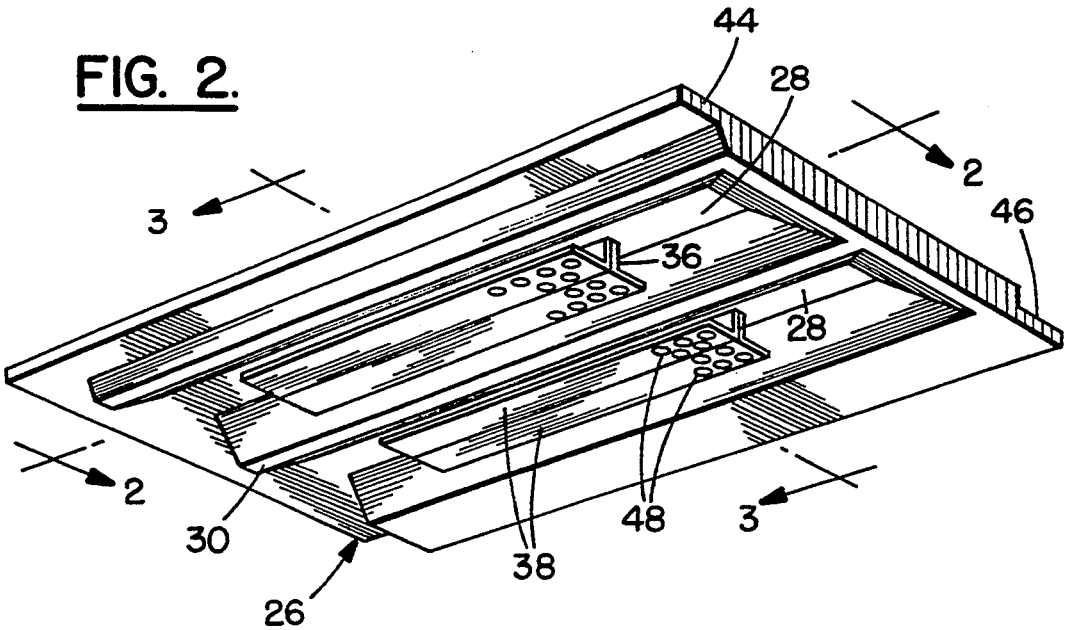
FIG. 2 is a perspective view of a roof tile employed in the construction of FIG. 1 and embodying the present invention.
Figure 3:
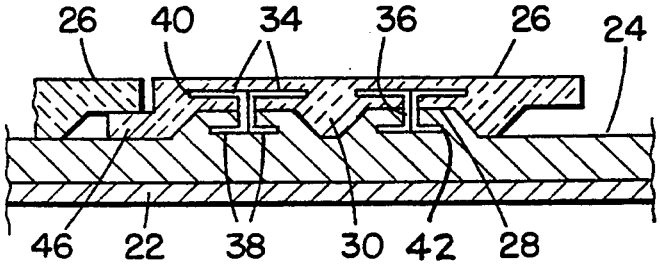
FIG. 3 is a cross section view taken generally along line 3—3 in FIG. 2.
Figure 4:
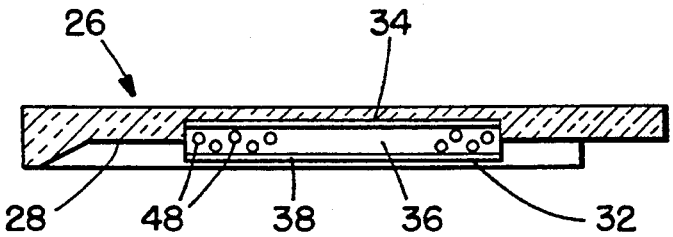
FIG. 4 is a cross section view taken generally along line 2—2 in FIG. 2.

Turn now to FIGS. 2, 3, and 4 for a description of one embodiment of a roof tile constructed in accordance with the invention. FIG. 2 depicts the underside of such a roof tile 26. In conventional fashion, it is generally rectangular in shape and includes a pair of elongated and longitudinally extending cavities 28 separated by an elongated and longitudinally extending ridge 30.

Anchors 32 for firmly attaching the roof tile 26 to the bonding material 24 are integrally attached to the roof tile 26 so that they extend in an aligned fashion within the elongated cavities 28. The anchors 32 may be composed of a suitable material such as, but not limited to, steel or other metals and their alloys, fiberglass, or even durable plastic materials. As seen particularly well in FIGS. 2 and 3, each anchor 32 has a first flange 34 which is embedded within the roof tile 26. It is envisioned that during the process of manufacture of the roof tiles 26, a pair of oppositely directed flanges 34 of each anchor 32 would be embedded within the roof tile 26 at a time when the roof tile was still in a liquid state. Then, when the roof tile solidifies, the anchor 32 is of unitary construction therewith. Each anchor 32 also includes a web member 36 which is integral with the first flanges 34. The web member 36 is substantially perpendicular to the flanges 34 and protrudes away from the roof tile 26 and into the cavity 28 thereof. The web 36 extends to a pair of oppositely directed second flanges 38 which are generally parallel to the flanges 34 and, of course, are spaced from them.

Figure 3A:
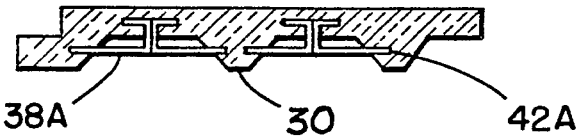
FIG. 3A is a cross section view, similar to FIG. 3, depicting a modified construction of a roof tile constructed according to the invention.

Although the first and second flange members 34, 38 are not necessarily of identical size, they are substantially coextensive with one another. Also, it will be appreciated that a lateral cross section through each anchor device, as depicted in FIG. 3, reveals a construction which is substantially symmetrical about a longitudinal axis of the web 36. In this regard, the web 36 is substantially centrally disposed relative to longitudinally extending edges 40 of the flange members 34 and longitudinally extending edges 42 of the flange members 38. Furthermore, the flange members 38 lie within the cavity 28 and are spaced from the flange members 34 by no greater distance than to be coplanar with the extremities of the ridges 30. This construction assures that the roof tiles 26 can be readily stacked and easily transported. This construction is, therefore, highly desirable, from a materials handling standpoint, including storage and shipping. While in FIG. 3 the edges 42 are shown spaced from the ridges 30, a modified construction is illustrated in FIG. 3A in which flanges 38A have longitudinally extending edges 42A embedded in the ridges 30. This construction results in a roof tile construction of optimum strength.

As most clearly seen in FIG. 3, roof tiles constructed in the manner just described are applied to discrete mounds 39 (FIG. 1) of the bonding material 24 which are applied to the underlayment 22 by means of a trowel or in some other suitable manner. The flange members 38 and web 36 of each anchor device 32 is forced into the bonding material 24. In FIG. 3, adjoining roof tiles 26 are illustrated positioned in a juxtaposed manner by means of their respective dove tails 44, 46 enabling them to overlie one another while remaining in a side by side relationship. After all of the tiles 26 for a roof have been applied to the bonding material 24 in the manner illustrated in FIG. 1, the bonding material 24 solidifies in time and the flange members 38 securely hold their associated roof tiles 26 in place. By reason of the symmetric construction of each anchor device 32 as previously described, tensile forces co-linear with the web member 36 and bending forces about a longitudinal axis of the anchor device are substantially restrained.

To further improve retention capability of the flange members 34 within the roof tile 26 and of the web member 36 and flange members 38 within the bonding material 24, it may be desirable to provide those elements of the anchor device with perforations 48.

Figure 6:
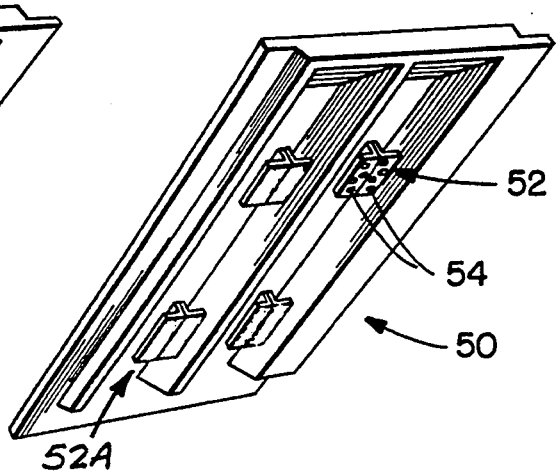

In another embodiment, illustrated in FIG. 6, a roof tile 50 is depicted as being provided with a plurality of anchor devices 52 generally having the construction of the anchor devices 32 previously described but smaller in size and spatially separated. For example, the roof tile 50 is illustrated as having the devices generally adjacent of its corners. While the anchor device 52 is illustrated as having perforations 54 therein, other anchor devices 52A are illustrated with plain, unbroken surfaces. In yet other instances, surfaces may be roughened to assure greater retention both by the material of the roof tile itself and by the bonding material 24 to which the roof tile 50 is to be attached.

Figure 5:
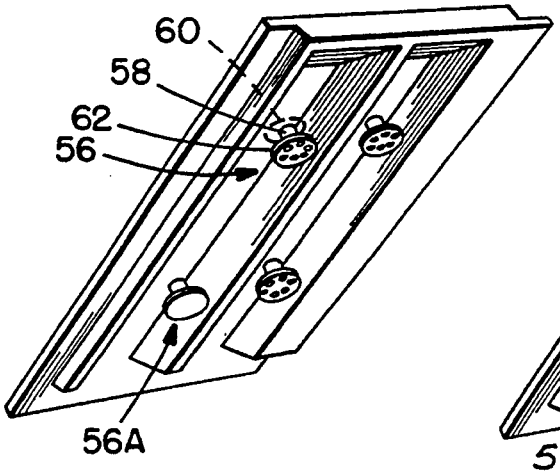
FIGS. 5 and 6 are perspective views illustrating typical rectangular roof tiles utilizing, respectively, two different types of anchor devices.

In FIG. 5, another embodiment of the invention is depicted. In this instance, a modified anchor device 56 is provided which includes a single stem member 58 and a pair of disk-shaped flange members 60, 62. As in previous constructions, the flange members 60, 62 are mutually perpendicular to the stem member 58 and are substantially coextensive. Again, while the flange members of the anchor device 56 are illustrated as being perforated, other anchor devices 56A illustrated in FIG. 6 are not so constructed.

Figure 7:
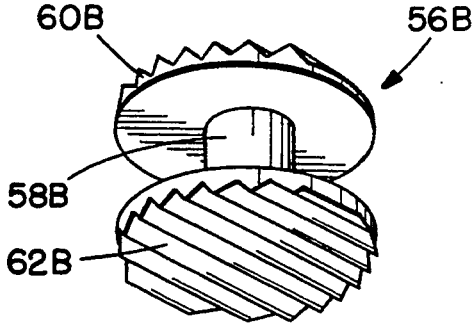
FIG. 7 is a detail perspective view of another embodiment of an anchor device of the invention.

In FIG. 7, another modified anchor device 56B is illustrated, which may be generally similar to the devices illustrated in FIG. 6. However, in this instance, flange members 60B and 62B are roughened in order to improve its retention capability in its associated surrounding material, whether it be the material of the tile member or the bonding material 24.

Figure 8:
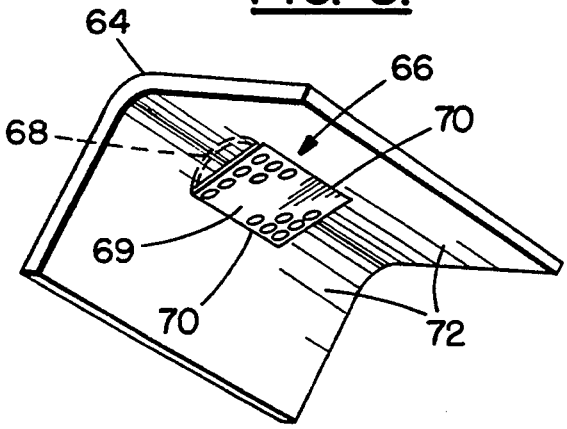
FIGS. 8, 9, and 10 are perspective views illustrating typical roof tiles of other than rectangular shape utilizing anchor devices of the present invention.

In FIG. 8 a cap roof tile 64 is illustrated for placement along the peak of the roof of the building 20. The cap roof tile 64 utilizes another modified anchor device 66. In this instance, an arcuate shaped flange member 68 is embedded in the similarly curved part of the roof tile 64 and is integrally attached to a planar base member 69 which has opposed edges 70 which engage the undersurfaces 72 of the roof tile.

Figure 9:
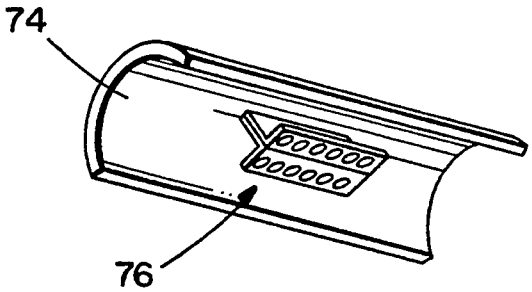

Another modified form of the invention is illustrated in FIG. 9 in which a barrel roof tile 74 is provided with an associated anchor device 76.

Figure 10:
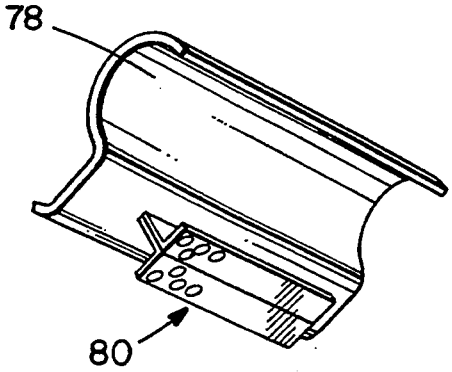

In still another typical construction, an S-tile 78 is illustrated in FIG. 10 as utilizing an incorporated anchor device 80.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is

1. A roof tile mounting system comprising:

a ceramic slab;

anchoring means for securing said ceramic slab to a contiguous layer of bonding material which is initially liquid and subsequently solidifies, said anchoring means including:

substantially planar first flange means embedded within said ceramic slab;

web means integral with said first flange means and extending transversely away from said first flange means and beyond said ceramic slab; and substantially planar second flange means integral with said web means at a location distant from said first flange means;

said first and second flange means being generally symmetrical relative to a longitudinal axis of said web means.

2. A roof tile mounting system as set forth in claim 1 wherein said first flange means is substantially parallel to said second flange means.

3. A roof tile mounting system as set forth in claim 1 wherein said first flange means has a first perimeter; wherein said second flange means has a second perimeter;

wherein said web means is fixed to said first flange means at a location substantially centrally of said first perimeter; and wherein said web means is fixed to said second flange means at a location substantially centrally of said second perimeter.

4. A roof tile mounting system as set forth in claim 1 wherein said first and second flange means have toughened surfaces.

5. A roof tile mounting system as set forth in claim 1 wherein at least one of said first flange means, said second flange means, and said web means is perforated.

6. A roof tile mounting system as set forth in claim 1 wherein said web means are rectangular and are perpendicular to said first and second flange means.

7. A roof tile mounting system as set forth in claim 1 wherein said web means include at least a single stem member substantially perpendicular to said first and second flange means.

8. A roof tile mounting system as set forth in claim 1 wherein said first and second flange means are disk-shaped.

9. A roof tile mounting system as set forth in claim 1 wherein said first and second flange means are mutually perpendicular to said web means and are substantially coextensive.

10. A roof tile mounting system as set forth in claim 1 including:

an underlayment adjacent the upper regions of a building;

a layer of bonding material overlying said underlayment said bonding material being initially liquid and subsequently solidifying to a hardened mass;

a plurality of said ceramic slabs positioned in side by side relationship on said bonding material thereby forming a continuous roof, said second flange means for each of said ceramic slabs being embedded within said bonding layer.

11. An anchoring device for securing a roof tile to a contiguous layer of bonding material which is initially liquid and subsequently solidifies, said anchoring device comprising:

substantially planar first flange means embedded within the roof tile;

web means integral with said first flange means and extending transversely away from said first flange means and beyond the roof tile; and substantially planar second flange means integral with said web means at a location distant from said first flange means;

said first and second flange means being generally symmetrical relative to a longitudinal axis of said web means.

12. An anchoring device as set forth in claim 11 wherein said first flange means is substantially parallel to said second flange means.

13. An anchoring device as set forth in claim 11 wherein said first flange means has a first perimeter; wherein said second flange means has a second perimeter;

wherein said web means is fixed to said first flange means at a location substantially central of said first perimeter; and wherein said web means is fixed to said second flange means at a location substantially central of said second perimeter.

14. An anchoring device as set forth in claim 11 wherein said first and second flange means have roughened surfaces.

15. An anchoring device as set forth in claim 11 wherein at least one of said first flange means and said second flange means and said web means is perforated.

16. An anchoring device as set forth in claim 11 wherein said web means are rectangular and are perpendicular to said first and second flange means.

17. A roof tile as set forth in claim 11 wherein said web means include at least a single stem member substantially perpendicular to said first and second flange means.

18. A roof tile as set forth in claim 11 wherein said first and second flange means are disk-shaped.

19. A roof tile as set forth in claim 11 wherein said first and second flange means are mutually perpendicular to said web means and are substantially coextensive.

20. A roof tile mounting system comprising:

an elongated ceramic slab having an elongated cavity defined by opposed ridges;

anchoring means for securing said ceramic slab to a contiguous layer of bonding material which is initially liquid and subsequently solidifies, said anchoring means including:

substantially planar first flange means embedded within said ceramic slab;

web means integral with said first flange means and extending transversely away from said first flange means and beyond said ceramic slab; and substantially planar second flange means within the cavity integral with said web means at a location distant from said first flange means, said second flange means having opposed edges embedded, respectively, in said opposed ridges;

said first and second flange means being generally symmetrical relative to a longitudinal axis of said web means.

* * * * *